US010617146B2

(12) United States Patent
Jin et al.

(10) Patent No.: US 10,617,146 B2
(45) **Date of Patent: *Apr. 14, 2020**

(54) METHOD OF MANUFACTURING A LYOCELL MATERIAL FOR A CIGARETTE FILTER

(71) Applicants: KOLON INDUSTRIES, INC., Gwacheon-si, Gyeonggi-do (KR); KT&G CORPORATION, Daejeon (KR)

(72) Inventors: Sang Woo Jin, Yongin-si (KR); Woo Chul Kim, Yongin-si (KR); Yong Kwan Cho, Yongin-si (KR); Jong Cheol Jeong, Yongin-si (KR); Sang Mok Lee, Yongin-si (KR); Sang Yoel Lee, Yongin-si (KR); Jong Yeol Kim, Daejeon (KR); Soo Ho Kim, Daejeon (KR); Bong Su Cheong, Daejeon (KR); Hyun Suk Cho, Daejeon (KR); Sung Jong Ki, Daejeon (KR); Hyeon Tae Kim, Daejeon (KR)

(73) Assignees: KOLON INDUSTRIES, INC., Seoul (KR); KT&G CORPORATION, Daejeon (KR)

( * ) Notice: Subject to any disclaimer, the term of this patent is extended or adjusted under 35 U.S.C. 154(b) by 157 days.

This patent is subject to a terminal disclaimer.

(21) Appl. No.: 15/540,873

(22) PCT Filed: Dec. 23, 2015

(86) PCT No.: PCT/KR2015/014207

§ 371 (c)(1),
(2) Date: Jun. 29, 2017

(87) PCT Pub. No.: WO2016/108508

PCT Pub. Date: Jul. 7, 2016

(65) Prior Publication Data

US 2018/0007952 A1 Jan. 11, 2018

(30) Foreign Application Priority Data

Dec. 31, 2014 (KR) ..... 10-2014-0196060

(51) Int. Cl.

| | |
|---|---|
| ***D01D 5/04*** | (2006.01) |
| ***D01D 5/06*** | (2006.01) |
| ***D01D 10/06*** | (2006.01) |
| ***D01F 2/02*** | (2006.01) |
| ***A24D 3/06*** | (2006.01) |
| ***A24D 3/10*** | (2006.01) |
| ***A24D 3/02*** | (2006.01) |
| ***D01D 5/22*** | (2006.01) |
| ***A24D 3/14*** | (2006.01) |
| ***D02G 1/12*** | (2006.01) |
| ***D01F 2/00*** | (2006.01) |
| ***D01F 1/02*** | (2006.01) |

(52) U.S. Cl.

CPC ..... *A24D 3/068* (2013.01); *A24D 3/02* (2013.01); *A24D 3/0204* (2013.01); *A24D 3/06* (2013.01); *A24D 3/10* (2013.01); *A24D 3/14* (2013.01); *D01D 5/22* (2013.01); *D01F 1/02* (2013.01); *D01F 2/00* (2013.01); *D02G 1/12* (2013.01)

(58) Field of Classification Search

CPC .. D01D 5/04; D01D 5/06; D01D 5/22; D01D 10/06; D01F 2/00; D01F 2/02; D02G 1/12

USPC ..... 264/168, 187, 207, 211.14, 211.15, 264/211.17; 28/263

See application file for complete search history.

(56) References Cited

U.S. PATENT DOCUMENTS

| | | | |
|---|---|---|---|
| 3,756,253 | A | 9/1973 | Honda et al. |
| 4,246,221 | A | 1/1981 | McCorsley |
| 4,416,698 | A | 11/1983 | McCorsley |
| 5,063,945 | A | 11/1991 | Sugihara et al. |
| 5,707,737 | A | 1/1998 | Mori et al. |
| 5,738,119 | A | 4/1998 | Edwards, III et al. |
| 6,017,479 | A | 1/2000 | Helms, Jr. et al. |
| 6,177,194 | B1 | 1/2001 | Koppe |
| 7,534,379 | B2 | 5/2009 | Ellison et al. |
| 2004/0126577 | A1 | 7/2004 | Lee et al. |
| 2004/0237982 | A1 | 12/2004 | Dollhopf et al. |

(Continued)

FOREIGN PATENT DOCUMENTS

| | | | |
|---|---|---|---|
| CN | 1123042 | A | 5/1996 |
| CN | 1139961 | A | 1/1997 |

(Continued)

OTHER PUBLICATIONS

International Search Report for PCT/KR2015/014207 dated Apr. 4, 2016.

(Continued)

*Primary Examiner* — Leo B Tentoni
(74) *Attorney, Agent, or Firm* — Sughrue Mion, PLLC

(57) ABSTRACT

This invention relates to a method of manufacturing a lyocell material for a cigarette filter, including (S1) spinning a lyocell spinning dope composed of 8 to 13 wt % of a cellulose pulp and 87 to 92 wt % of an N-methylmorpholine-N-oxide (NMMO) aqueous solution; (S2) coagulating the lyocell spinning dope spun in (S1), thus obtaining a lyocell multifilament; (S3) water-washing the lyocell multifilament obtained in (S2); (S4) oiling the lyocell multifilament water-washed in (S3); and (S5) applying steam and pressure to the lyocell multifilament obtained in (S4), thus obtaining a crimped tow having 30 to 40 crimps per inch.

6 Claims, No Drawings

(56) References Cited

U.S. PATENT DOCUMENTS

| | | | | |
|---|---|---|---|---|
| 2005/0019564 | A1 | 1/2005 | Kwon et al. | |
| 2005/0160939 | A1 | 7/2005 | Kwon et al. | |
| 2005/0283958 | A1 | 12/2005 | Sanderson et al. | |
| 2005/0287368 | A1 | 12/2005 | Corallo et al. | |
| 2009/0127750 | A1 | 5/2009 | Bhushan et al. | |
| 2010/0021711 | A1 | 1/2010 | Schrempf et al. | |
| 2010/0281662 | A1 | 11/2010 | Manner et al. | |
| 2016/0286854 | A1* | 10/2016 | Jeong | D02G 1/12 |
| 2017/0156394 | A1 | 6/2017 | Jeong et al. | |

FOREIGN PATENT DOCUMENTS

| | | | | |
|---|---|---|---|---|
| CN | 1356412 | A | 7/2002 | |
| CN | 1576403 | A | 2/2005 | |
| CN | 1688637 | A | 10/2005 | |
| CN | 101501252 | A | 8/2009 | |
| CN | 102595942 | A | 7/2012 | |
| DE | 10053359 | A1 | 5/2002 | |
| EP | 797696 | B1 | 7/1998 | |
| EP | 0 766 519 | | 11/1998 | |
| EP | 703997 | B1 | 8/1999 | |
| EP | 2490557 | A1 | 8/2012 | |
| EP | 3051011 | A1 | 8/2016 | |
| GB | 1155070 | A * | 6/1969 | D02G 1/12 |
| GB | 2474694 | | 4/2011 | |
| JP | 48-80824 | A | 10/1973 | |
| JP | 9-509987 | A | 10/1997 | |
| JP | 10-168650 | A | 6/1998 | |
| JP | 10-505886 | A | 6/1998 | |
| JP | 2001-501687 | A | 2/2001 | |
| JP | 2001-510245 | A | 7/2001 | |
| JP | 2001-316936 | A | 11/2001 | |
| JP | 2005-42286 | A | 2/2005 | |
| JP | 2007-534789 | A | 11/2007 | |
| JP | 2009-540139 | A | 11/2009 | |
| KR | 10-2003-0061374 | A | 7/2003 | |
| KR | 10-0471549 | B1 | 3/2005 | |
| KR | 10-0769974 | B1 | 10/2007 | |
| KR | 10-2012-0032932 | A | 4/2012 | |
| KR | 10-1455006 | B1 | 10/2014 | |
| KR | 10-1455002 | B1 | 11/2014 | |
| WO | 94-27903 | A1 | 12/1994 | |
| WO | 94/28220 | | 12/1994 | |
| WO | 95/24520 | | 9/1995 | |
| WO | 0063470 | | 10/2000 | |
| WO | 2006/071101 | | 7/2006 | |
| WO | 2007/143762 | A1 | 12/2007 | |
| WO | 2009/000453 | | 12/2008 | |
| WO | 2011/048397 | A1 | 4/2011 | |
| WO | 2012002729 | A2 | 1/2012 | |
| WO | 2014/009498 | | 1/2014 | |

OTHER PUBLICATIONS

European Patent Office, Communication dated Jul. 12, 2018, issued in Application No. 15875602.3.

Chavan et al., "Development and Processing of Lyocell", Indian Journal of Fibre & Textile Research, vol. 29, Dec. 2004, pp. 483-492, 10 pages total.

European Patent Office, Supplementary European Search Report dated Feb. 1, 2017 by the European Patent Office in European Application No. 14 817842.

International Search Report of PCT/KR2014/004881 dated Aug. 27, 2014 [PCT/ISA/210].

Japanese Patent Office, Communication dated Dec. 14, 2016, issued in counterpart Japanese Application No. 2016-523626.

Russian Patent Office, Communication dated May 25, 2017 in counterpart Russian Application No. 2016102643.

The State Intellectual Property Office of People's Republic of China; Communication dated Jan. 17, 2017 in counterpart application No. 201480036781.8.

Tencel HS260 Lyocell Fiber for Nonwovens, 1 page total.

European Paetnt Office, Communication dated Oct. 2, 2018 in European Application No. 15815965.7.

European Patent Office; Communication dated Feb. 8, 2018, in conterpart application No. 15815965.7.

International Search Report of PCT/KR2015/006665 dated Sep. 22, 2015 [PCT/ISA/210].

Japanese Patent Office; Communication dated Jul. 2, 2018 in counterpart JP application No. 2016-574041.

Japanese Patent Office; Communication dated Oct. 30, 2017 in counterpart application No. 2016-574041.

The State Intellectual Property Office of the P.R.C.; Communication dated Jul. 9, 2018 in counterpart CN application No. 201580035675.2.

"Lubrication", Random House Dictionary, copyright Random House, Inc. 2017, accessed at Dictionary.com on Sep. 26, 2017, 2 pages total.

Bajaj, P., "Spin Finishes for Manufactured Fibres", Manufactured Fibre Technology, 1997, Chapman & Hall, London, 31 pages total.

United States Patent and Trademark Office, communication dated Oct. 4, 2017 in U.S. Appl. No. 14/392,274.

United States Patent and Trademark Office, communication dated Apr. 26, 2018 in U.S. Appl. No. 14/392,274.

United States Patent and Trademark Office, communication dated Sep. 21, 2018 in U.S. Appl. No. 14/392,274.

United States Patent and Trademark Office, communication dated Mar. 4, 2019 in U.S. Appl. No. 14/392,274.

United States Patent and Trademark Office, communication dated Jul. 5, 2019 in U.S. Appl. No. 15/322,753.

* cited by examiner

METHOD OF MANUFACTURING A LYOCELL MATERIAL FOR A CIGARETTE FILTER

CROSS REFERENCE TO RELATED APPLICATIONS

This application is a National Stage of International Application No. PCT/KR2015/014207 filed Dec. 23, 2015, claiming priority based on Korean Patent Application No. 10-2014-0196060 filed Dec. 31, 2014, the contents of all of which are incorporated herein by reference in their entirety.

TECHNICAL FIELD

The present invention relates to a lyocell material for a cigarette filter and a method of manufacturing the same.

BACKGROUND ART

A cigarette filter is mostly made of cellulose acetate fibers. A cellulose acetate fiber is currently manufactured as follows. Specifically, a cellulose acetate flake is dissolved in a solvent such as acetone, thus preparing a cellulose acetate spinning dope. The spinning dope thus prepared is supplied into a spinning nozzle device and spun using a dry-spinning process at a high temperature, resulting in a cellulose acetate fiber.

In particular, as for a cellulose acetate fiber useful as a fiber for a cigarette filter, in order to facilitate the manufacture of a cigarette filter, total fineness is appropriately set, and a fiber tow having crimps is manufactured. A cigarette filter is fabricated in a manner in which the cellulose acetate fiber tow is opened using a cigarette filter plug winding device, impregnated with a plasticizer, formed into a rod using a filter-winding paper, and cut to a predetermined size.

Commonly, cellulose acetate obtained by subjecting cellulose to acetic acid esterification is known to be a biodegradable material. However, even when a cigarette filter made of cellulose acetate fiber is buried in the soil, its shape is still maintained for 1 to 2 years, and a considerably long period of time is required in order to completely biodegrade the cigarette filter buried in the soil.

The cigarette filter is assembled into a cigarette product, distributed to consumers, provided for smoking, and finally discarded after a cigarette is smoked. Also, the cigarette filter may be directly wasted as the manufacturing residue in the plants for manufacturing a cigarette filter. Such cigarette filter waste is collected as garbage and is then buried. In some cases, the smoked cigarette is not collected as garbage but may be allowed to remain in the natural environment. Cigarette filter waste is not just a visual problem, but it has been found that the toxins in used cigarette filters leach into the environment and potentially represent a biological hazard.

In this situation, there have been proposed various methods of manufacturing a biodegradable cigarette filter. In this regard, in order to increase the rate of decomposition of cellulose acetate as the biodegradable polymer, an additive is added, or cellulose acetate having few substitutions is used to increase biodegradability. Alternatively, as a filter tow material, the use of a polymer composite having high biodegradability comprising PHB (poly-hydroxybutyrate)/PVB(polyvinyl butyral) and starch has been proposed.

However, no satisfactory commercial solution has yet been proposed to produce a filter that can break down quickly enough to overcome the garbage problem and thus be acceptable to consumers. This is because a method capable of simultaneously satisfying the cigarette preference and absorption profile during smoking as a cigarette filter while achieving a biodegradation rate fast enough to solve the environmental problem has not yet been achieved.

Meanwhile, in the case of a lyocell fiber manufactured from natural pulp and amine oxide hydrate, superior tension properties and a superior tactile sense may be exhibited compared to existing regenerated fibers. The amine oxide-based solvent used to prepare the lyocell fiber may be recycled, and may biodegrade even when discarded, and thus the production process does not generate any pollutants, and research on lyocell fibers as an environmentally friendly regenerated fiber has recently become more active.

As disclosed in U.S. Pat. Nos. 4,416,698 and 4,246,221, the method of manufacturing lyocell fiber includes spinning a spinning dope obtained by dissolving cellulose in amine oxide (NMMO) and coagulating it to give filaments, followed by water washing, drying and post-processing. Furthermore, the lyocell fiber is not naturally wound, but may be usefully employed in a manner in which the wet fiber is compressed by the method disclosed in European Patent Application Publication No. 797,696, or in which crimps may be formed through stuffer box-winding processing using a dry vapor by the method disclosed in European Patent Application Publication No. 703,997.

For existing lyocell fibers, blooming properties due to the formation of crimps are not good, and in most conventional techniques, only the physical properties of lyocell fibers, such as strength and the like, are improved. However, the material for a cigarette filter is required to have good crimping properties, and in order to efficiently apply the biodegradable lyocell fiber to the cigarette filter, research and development is ongoing into improving the crimping properties of a lyocell material so as to satisfy the properties required of the material for a cigarette filter by ensuring a large number of crimps.

DISCLOSURE

Technical Problem

Accordingly, the present invention is intended to provide a lyocell material for a cigarette filter and a method of manufacturing the same, wherein the lyocell material has high biodegradability and a large number of crimps and may thus satisfy the properties required of a material for a cigarette filter.

Technical Solution

Therefore, a preferred first embodiment of the present invention provides a method of manufacturing a lyocell material for a cigarette filter, comprising: (S1) spinning a lyocell spinning dope comprising 8 to 13 wt % of a cellulose pulp and 87 to 92 wt % of an N-methylmorpholine-N-oxide (NMMO) aqueous solution; (S2) coagulating the lyocell spinning dope spun in (S1), thus obtaining a lyocell multifilament; (S3) water-washing the lyocell multifilament obtained in (S2); (S4) oiling the lyocell multifilament water-washed in (S3); and (S5) applying steam and pressure to the lyocell multifilament obtained in (S4), thus obtaining a crimped tow having 30 to 40 crimps per inch.

In the first embodiment, in the lyocell spinning dope of (S1), the cellulose pulp may comprise 85 to 99 wt % of alpha-cellulose, and may have a degree of polymerization (DPw) of 600 to 1700.

In the first embodiment, the coagulating in (S2) may comprise primary coagulation using air quenching (Q/A) including supplying cold air to the spinning dope and secondary coagulation including immersing the primarily coagulated spinning dope in a coagulation solution.

Here, the air quenching may be performed by supplying the cold air at a temperature of 4 to 15° C. and a wind velocity of 30 to 120 m/s to the spinning dope, and the coagulation solution preferably has a temperature of 30° C. or less.

In the first embodiment, (S5) may be performed using a stuffer box, and the stuffer box is preferably controlled so that a steam pressure is 0.1 to 3 kgf/cm$^2$, a press roller pressure is 1.5 to 4 kgf/cm$^2$, and an upper plate pressure is 0.1 to 3 kgf/cm$^2$.

In addition, a preferred second embodiment of the present invention provides a lyocell material for a cigarette filter, manufactured by spinning a lyocell spinning dope comprising a cellulose pulp and an N-methylmorpholine-N-oxide (NMMO) aqueous solution to produce a lyocell multifilament and applying steam and pressure to the lyocell multifilament to give a crimped tow, wherein the crimped tow has 30 to 40 crimps per inch.

In the second embodiment, the lyocell spinning dope may comprise 8 to 13 wt % of a cellulose pulp and 87 to wt % of an N-methylmorpholine-N-oxide (NMMO) aqueous solution. Here, the cellulose pulp may comprise 85 to 99 wt % of alpha-cellulose and may have a degree of polymerization (DPw) of 600 to 1700.

Advantageous Effects

According to the present invention, a lyocell crimped tow, having high biodegradability and an increased number of crimps and exhibiting properties suitable for use as a material for a cigarette filter, can be provided. When the lyocell crimped tow of the invention is applied, the cigarette preference and absorption profile can be further improved.

BEST MODE

An aspect of the present invention addresses a method of manufacturing a lyocell material for a cigarette filter, comprising the steps of (S1) spinning a lyocell spinning dope comprising 8 to 13 wt % of a cellulose pulp and 87 to 92 wt % of an N-methylmorpholine-N-oxide (NMMO) aqueous solution; (S2) coagulating the lyocell spinning dope spun in (S1), thus obtaining a lyocell multifilament; (S3) water-washing the lyocell multifilament obtained in (S2); (S4) oiling the lyocell multifilament water-washed in (S3); and (S5) applying steam and pressure to the lyocell multifilament obtained in (S4), thus obtaining a crimped tow having 30 to 40 crimps per inch.

Below is a detailed description of the steps of the method of manufacturing a lyocell material for a cigarette filter according to the present invention.

[(S1) Step]

In the present invention, (S1) is a step of spinning a lyocell spinning dope comprising a cellulose pulp and an N-methylmorpholine-N-oxide (NMMO) aqueous solution. Here, the lyocell spinning dope may include 8 to 13 wt % of a cellulose pulp and 87 to 92 wt % of an NMMO aqueous solution, and the cellulose pulp may include 85 to 99 wt % of alpha-cellulose and may have a degree of polymerization (DPw) of 600 to 1700.

If the amount of cellulose pulp is less than 8 wt %, it is difficult to acquire fibrous properties. On the other hand, if the amount thereof exceeds 13 wt %, dissolution in the aqueous solution may become difficult. Also, if the amount of the NMMO aqueous solution is less than 87 wt %, the dissolution viscosity may remarkably increase, which is undesirable. On the other hand, if the amount thereof exceeds 92 wt %, spinning viscosity may considerably decrease, making it difficult to manufacture uniform fibers in a spinning process.

The weight ratio of NMMO and water in the NMMO aqueous solution may fall in the range of 93:7 to 85:15. If the weight ratio of NMMO and water exceeds 93:7, the dissolution temperature may increase, and thus cellulose may decompose upon the dissolution of cellulose. On the other hand, if the weight ratio thereof is less than 85:15, the dissolution performance of the solvent may deteriorate, making it difficult to dissolve cellulose.

The spinning dope is discharged from the spinning nozzle of a donut-shaped spinneret. As such, the spinneret functions to discharge the filamentary spinning dope into a coagulation solution in a coagulation bath through an air gap. Discharging the spinning dope from the spinneret may be performed at a temperature of 100 to 110° C.

[(S2) Step]

In the present invention, (S2) is a step of coagulating the lyocell spinning dope spun in (S1) to obtain a lyocell multifilament. The coagulation in (S2) may include primary coagulation, including subjecting the spinning dope to air quenching (Q/A) using cold air, and secondary coagulation, including immersing the primarily coagulated spinning dope in a coagulation solution.

After the spinning dope is discharged through the donut-shaped spinneret in (S1), the dope may pass through the air gap between the spinneret and the coagulation bath. In the air gap, cold air is supplied outwards from an air-cooling part positioned inside the donut-shaped spinneret, and primary coagulation may be carried out by air quenching for supplying the cold air to the spinning dope.

The factors that have an influence on the properties of the lyocell multifilament obtained in (S2) include the temperature and the wind velocity of the cold air in the air gap, and the coagulating in (S2) may be performed by supplying the cold air at a temperature of 4 to 15° C. and a wind velocity of 30 to 120 m/s to the spinning dope.

If the temperature of the cold air upon primary coagulation is lower than 4° C., the surface of the spinneret may be immediately cooled, and thus the cross-section of the lyocell multifilament may become non-uniform and spinning processability may deteriorate. On the other hand, if the temperature thereof is higher than 15° C., primary coagulation using the cold air is not sufficient, thus deteriorating spinning processability.

Also, if the wind velocity of the cold air upon primary coagulation is less than 5 m/s, primary coagulation using the cold air is not sufficient, undesirably causing yarn breakage. On the other hand, if the wind velocity thereof exceeds 60 m/s, the spinning dope discharged from the spinneret may be shaken by the air, and spinning processability may thus deteriorate.

After primary coagulation using air quenching, the spinning dope is supplied into the coagulation bath containing the coagulation solution to undergo secondary coagulation. In order to appropriately carry out secondary coagulation, the temperature of the coagulation solution may be set to 30° C. or less. This is to properly maintain the coagulation rate because the temperature for secondary coagulation is not excessively high. The coagulation solution may be prepared without particular limitation so long as it has a composition that is typical in the art to which the present invention belongs.

[(S3) Step]

In the present invention, (S3) is a step of water-washing the lyocell multifilament obtained in (S2). Specifically, the lyocell multifilament obtained in (S2) is transferred into a water-washing bath by means of a draw roller, and is thus washed with water.

Upon water-washing of the filament, a water-washing solution at 0 to 100° C. may be used, taking into consideration the recovery and reuse of the solvent after the water-washing process. The water-washing solution may include water, and may further include other components, as necessary.

[(S4) Step]

In the present invention, (S4) is a step of oiling the lyocell multifilament water-washed in (S3), and drying is preferably conducted after oiling treatment. The oiling treatment may be performed by completely immersing the multifilament in oil, and the amount of oil on the filament may be maintained uniform using a press roller attached to the entry roll and the release roll of an oiling device. The oil functions to decrease friction of the filament upon contact with the drying roller and the guide and in the crimping process and also to efficiently form crimps on fibers. The oil is not particularly limited so long as it is one that is typically used for the production of filaments.

[(S5) Step]

(S5) is a step of crimping the lyocell multifilament oiled in (S4) using steam and pressure. Thereby, a crimped tow may be obtained through (S5).

As used herein, the term "crimping" means that a filament is made wavy to realize the bulky properties of fiber. In the present invention, the crimping process may be performed using a stuffer box with press rollers, thereby obtaining a crimped tow having 30 to 40 crimps per inch.

Here, the stuffer box is preferably controlled so as to satisfy a steam pressure of 0.1 to 3 kgf/cm$^2$, a press roller pressure of 1.5 to 4 kgf/cm$^2$ and an upper plate pressure of 0.1 to 3 kgf/cm$^2$. If the steam pressure is less than 0.1 kgf/cm$^2$, crimps are not efficiently formed. On the other hand, if the steam pressure exceeds 3 kgf/cm$^2$, an excess of steam is supplied, and the shape of the formed crimps may not be uniformly maintained.

Furthermore, if the press roller pressure is less than 1.5 kgf/cm$^2$, the desired number of crimps may not be formed. On the other hand, if this pressure exceeds 4 kgf/cm$^2$, the pressing force is too strong, and thus the amount of water or oil present in the tow may drastically decrease, whereby the filaments do not pass through the stuffer box. Here, the press rollers are preferably maintained at an interval of 0.01 to 3.0 mm. If the press roller interval is less than 0.01 mm, the pressure applied to the filaments by the rollers is increased, making it impossible to form crimps or causing damage to the formed filaments due to the surface friction. On the other hand, if the press roller interval exceeds 3.0 mm, filament slipping may occur between the press rollers, making it difficult to form uniform crimps.

If the pressure of the upper plate, which moves up and down in order to form uniform crimps after having passed through the press rollers, is less than 0.1 kgf/cm$^2$, the upper plate is not fixed due to the inner pressure of the stuffer box and the tow may be retained within the stuffer box for a long period of time, making it impossible to maintain continuous processing. On the other hand, if the pressure thereof exceeds 3 kgf/cm$^2$, steam cannot be efficiently discharged from the stuffer box, and thus the crimps may be irregularly shaped.

The crimped tow obtained under the above conditions has at least 30 crimps per inch, and preferably 30 to 40 crimps per inch. When it is provided in the form of a filter rod having a diameter of 16.5 mm to 24.5 mm, suction resistance of about 185 to 620 PD (mm$H_2O$) based on KS H ISO 6565 may result. Accordingly, the lyocell crimped tow of the present invention may biodegrade and disappear within a short time and is thus environmentally friendly, and when it is manufactured into a cigarette filter, required properties, such as suction resistance, filter hardness, filter removal efficiency, etc., may be satisfied, and the effects thereof may be maximized.

MODE FOR INVENTION

A better understanding of the present invention may be obtained through the following Examples, which are set forth to illustrate, but are not to be construed as limiting the scope of the present invention.

EXAMPLE 1

A spinning dope having a concentration of 12 wt % for manufacturing a lyocell material was prepared by mixing a cellulose pulp having DPw of 820 and 93.9% of alpha-cellulose with an NMMO/$H_2O$ solvent mixture (at a weight ratio of NMMO/$H_2O$: 90/10) containing 0.01 wt % of propyl gallate. The spinning dope was spun via the spinning nozzle of a donut-shaped spinneret under the condition that the spinning temperature was maintained at 110° C., while the amount of the spinning dope to be discharged and the spinning rate were adjusted so that the fineness per filament was 3.0 denier.

Subsequently, the filamentary spinning dope discharged from the spinning nozzle was supplied into a coagulation solution in a coagulation bath through an air gap. As such, the spinning dope was primarily coagulated using cold air at a temperature of 8° C. and a wind velocity of 50 m/s in the air gap. Then, secondary coagulation was carried out using a coagulation solution comprising 85 wt % of water and 15 wt % of NMMO at a temperature of 25° C. As such, the concentration of the coagulation solution was continuously monitored using a sensor and a refractometer.

Subsequently, the coagulated filaments were drawn in the air layer through a draw roller and then washed with a water-washing solution sprayed using a water-washing device to remove the remaining NMMO, after which the filaments were sufficiently uniformly impregnated with oil and then pressed so that the filaments had an oil content of 0.2%. Subsequently, the oiled filaments were dried at 150° C. using a drying roller, heated while passing through a stuffer box, and then crimped through press rollers in the stuffer box, thereby completing a lyocell crimped tow. Here, steam was supplied at 0.5 kgf/cm$^2$ and the pressure and interval of the press rollers were 1.5 kgf/cm$^2$ and 1.5 mm, respectively, and the upper plate pressure was set to 1.0 kgf/cm$^2$.

EXAMPLE 2

A lyocell material for a cigarette filter was manufactured in the same manner as in Example 1, with the exception that the crimped tow was obtained using the stuffer box under the condition that steam of 1.0 kgf/cm$^2$ was supplied, the pressure and interval of the press rollers were 2.0 kgf/cm$^2$ and 1.2 mm, respectively, and the upper plate pressure was set to 1.5 kgf/cm$^2$.

EXAMPLE 3

A lyocell material for a cigarette filter was manufactured in the same manner as in Example 1, with the exception that the crimped tow was obtained using the stuffer box under the condition that steam of 1.5 kgf/cm$^2$ was supplied, the pressure and interval of the press rollers were 3.0 kgf/cm$^2$ and 1.0 mm, respectively, and the upper plate pressure was set to 2.0 kgf/cm$^2$.

COMPARATIVE EXAMPLE 1

A lyocell material for a cigarette filter was manufactured in the same manner as in Example 1, with the exception that the crimped tow was obtained using the stuffer box under the condition that steam of 0.5 kgf/cm$^2$ was supplied, the pressure and interval of the press rollers were 2.0 kgf/cm$^2$ and 2.0 mm, respectively, and the upper plate pressure was not applied.

COMPARATIVE EXAMPLE 2

A lyocell material for a cigarette filter was manufactured in the same manner as in Example 1, with the exception that the crimped tow was obtained using the stuffer box under the condition that steam of 1.0 kgf/cm$^2$ was supplied, the pressure and interval of the press rollers were 3.0 kgf/cm$^2$ and 1.5 mm, respectively, and the upper plate pressure was set to 3.5 kgf/cm$^2$.

COMPARATIVE EXAMPLE 3

A lyocell material for a cigarette filter was manufactured in the same manner as in Example 1, with the exception that the crimped tow was obtained using the stuffer box under the condition that steam of 1.5 kgf/cm$^2$ was supplied, the pressure and interval of the press rollers were 4.0 kgf/cm$^2$ and 1.0 mm, respectively, and the upper plate pressure was not applied.

COMPARATIVE EXAMPLE 4

A lyocell material for a cigarette filter was manufactured in the same manner as in Example 1, with the exception that the crimped tow was obtained using the stuffer box under the condition that steam of 2.0 kgf/cm$^2$ was supplied, the pressure and interval of the press rollers were 5.0 kgf/cm$^2$ and 3.5 mm, respectively, and the upper plate pressure was set to 1.5 kgf/cm$^2$.

<Measurement>

(1) Measurement of the number of crimps: According to KS K 0326, twenty fiber specimens in which crimps were not damaged were adhered to a prepared glossy paper sheet (with a space distance of 25 mm) using an amyl acetate adhesive comprising 4 to 5% celluloid so that each fiber specimen was extended by (25±5)% relative to the space distance, after which the specimens were allowed to stand to dry the adhesive. The number of crimps in 25 mm was counted when an initial load of 1.96/1000 cN (2 mgf) per 1 D was applied to each specimen using a crimp tester, and the average value thereof was determined to one decimal place.

(2) Crimp uniformity: According to the above method of measuring the number of crimps, the width of the non-uniform crimp X relative to the width of the tow of the sampled specimen was measured and the grade of crimps was determined based on the criteria shown in Table 1 below.

TABLE 1

| Grade (crimp state) | ◎ | ○ | Δ | X |
|---|---|---|---|---|
| Width ratio of non-uniform crimp | $0 < X \leq 0.1$ | $0.1 < X \leq 0.5$ | $0.5 < X \leq 1$ | All non-uniform |

(3) Suction Resistance

Using the tows manufactured in the above Examples and Comparative Examples, filter rods having a uniform diameter were manufactured, and the suction resistance thereof was measured using a suction resistance tester compliant with the KS H ISO 6565 standard.

TABLE 2

| | Steam pressure (kgf/cm$^2$) | Press roller pressure (kgf/cm$^2$) | Plate pressure (kgf/cm$^2$) | No. of crimps (crimps/inch) | Crimp state | Suction resistance (PD) |
|---|---|---|---|---|---|---|
| Ex.1 | 0.5 | 1.5 | 1.0 | 30 | ○ | 340 |
| Ex.2 | 1.0 | 2.0 | 1.5 | 34 | ◎ | 320 |
| Ex.3 | 1.5 | 3.0 | 2.0 | 38 | ○ | 300 |
| C.Ex.1 | 0.5 | 2.0 | X | — | X | — |
| C.Ex.2 | 1.0 | 3.0 | 3.5 | 42 | Δ | 280 |
| C.Ex.3 | 1.5 | 4.0 | X | 20 | X | 260 |
| C.Ex.4 | 2.0 | 5.0 | 1.5 | — | X | — |

Based on the results of measurement of the properties, as is apparent from Table 2, the crimped tows of Examples 1 to 3 had at least 30 crimps per inch, and the crimp state thereof was generally good. Thus, suction resistance of 300 to 340, required of a regular-type cigarette filter, was satisfied. However, in Comparative Examples 1 to 4, the number of crimps was relatively low compared to the Examples, and the crimp state was poor. In particular, in Comparative Example 2, the upper plate pressure was excessively applied, and thus the retention time of crimps was prolonged, whereby the number of crimps was increased but the crimp state was poor and suction resistance was not uniform.

Furthermore, the upper plate pressure was not applied in Comparative Examples 1 and 3, and thus crimps were not formed or a small number of crimps was formed, and in Comparative Example 4, in which the press roller pressure was too high, the amount of water or oil present in the tow was drastically decreased and thus the crimps were not normally formed. In the case where the processing of the present invention was performed under conditions falling out of the above processing ranges, a tow having good crimps could not be formed, and thus suction resistance was remarkably decreased, making it unsuitable for use in a fiber for a cigarette filter.

The invention claimed is:

1. A method of manufacturing a lyocell material for a cigarette filter, comprising:

(S1) spinning a lyocell spinning dope comprising 8 to 13 wt % of a cellulose pulp and 87 to 92 wt % of an N-methylmorpholine-N-oxide (NMMO) aqueous solution;

(S2) coagulating the lyocell spinning dope spun in (S1), thus obtaining a lyocell multifilament;

(S3) water-washing the lyocell multifilament obtained in (S2);

(S4) oiling the water-washed lyocell multifilament obtained in (S3); and (S5) applying steam and pressure to the lyocell multifilament obtained in (S4) to give a crimped tow having 30 to 40 crimps per inch, wherein the (S5) is performed using a stuffer box, wherein an upper plate pressure of the stutter box is 0.1 to 3 $kgf/cm^2$ and an interval of press rollers of the stuffer box is 0.01 to 3.0 mm.

2. The method of claim 1, wherein in the lyocell spinning dope of (S1), the cellulose pulp comprises 85 to 99 wt % of alpha-cellulose and has a degree of polymerization (DPw) of 600 to 1700.

3. The method of claim 1, wherein the coagulating in (S2) comprises a primary coagulation using air quenching including supplying cold air to the spinning dope and a secondary coagulation including immersing the primarily coagulated spinning dope in a coagulation solution.

4. The method of claim 3, wherein the air quenching is performed by supplying the cold air at a temperature of 4 to 15° C. and a speed of 30 to 120 m/s to the spinning dope, and the coagulation solution has a temperature of 30° C. or less.

5. The method of claim 1, wherein the stuffer box is controlled so that a steam pressure is 0.1 to 3 $kgf/cm^2$ and a press roller pressure is 1.5 to 4 $kgf/cm^2$.

6. The method of claim 1, wherein the upper plate pressure is 1.0 to 3 $kgf/cm^2$.

* * * * *